US006967582B2

(12) United States Patent
Tice et al.

(10) Patent No.: US 6,967,582 B2
(45) Date of Patent: Nov. 22, 2005

(54) DETECTOR WITH AMBIENT PHOTON SENSOR AND OTHER SENSORS

(75) Inventors: Lee D. Tice, Bartlett, IL (US); Dragan Petrovic, Geneva, IL (US); Paul J. Sistare, St. Charles, IL (US)

(73) Assignee: Honeywell International Inc., Morristown, NJ (US)

( * ) Notice: Subject to any disclaimer, the term of this patent is extended or adjusted under 35 U.S.C. 154(b) by 96 days.

(21) Appl. No.: 10/247,106

(22) Filed: Sep. 19, 2002

(65) Prior Publication Data

US 2003/0020617 A1 Jan. 30, 2003

(51) Int. Cl.[7] ..... G08B 17/00

(52) U.S. Cl. ..... 340/630; 340/628; 340/577; 340/587; 340/522; 340/643

(58) Field of Search ..... 340/630, 628, 340/629, 632, 633, 577, 578, 587, 588, 522, 340/641, 643

(56) References Cited

U.S. PATENT DOCUMENTS

| | | | | |
|---|---|---|---|---|
| 3,313,946 | A | 4/1967 | Goodwin et al. | |
| 3,826,180 | A | 7/1974 | Hayashi | |
| 3,938,115 | A | 2/1976 | Jacoby | |
| 4,016,524 | A | 4/1977 | Pompei et al. | |
| 4,059,385 | A * | 11/1977 | Gulitz et al. | 431/12 |
| 4,088,986 | A | 5/1978 | Boucher | |
| 4,638,304 | A | 1/1987 | Kimura et al. | |
| 4,639,605 | A | 1/1987 | Seki et al. | |
| 4,640,628 | A | 2/1987 | Seki et al. | |
| 4,668,939 | A | 5/1987 | Kimura et al. | |
| 4,688,021 | A | 8/1987 | Buck et al. | |
| 4,725,820 | A | 2/1988 | Kimura | |
| 4,857,912 | A | 8/1989 | Everett et al. | |
| 4,884,222 | A | 11/1989 | Nagashima et al. | |
| 5,103,096 | A | 4/1992 | Wong | |
| 5,153,563 | A * | 10/1992 | Goto et al. | 340/578 |
| 5,260,687 | A | 11/1993 | Yamauchi et al. | |
| 5,557,262 | A * | 9/1996 | Tice | 340/587 |
| 5,568,130 | A | 10/1996 | Dahl | |
| 5,659,292 | A | 8/1997 | Tice | |
| 5,691,703 | A | 11/1997 | Roby et al. | |
| 5,691,704 | A | 11/1997 | Wong | |
| 5,694,208 | A * | 12/1997 | Ichikawa | 356/73 |
| 5,736,928 | A | 4/1998 | Tice et al. | |
| 5,786,767 | A | 7/1998 | Severino | |
| 5,793,295 | A | 8/1998 | Goldstein | |
| 5,801,633 | A | 9/1998 | Soni | |
| 5,831,524 | A | 11/1998 | Tice et al. | |
| 5,896,082 | A | 4/1999 | MacFarlane | |
| 5,914,656 | A | 6/1999 | Ojala et al. | |
| 5,945,924 | A * | 8/1999 | Marman et al. | 340/928 |
| 5,969,604 | A | 10/1999 | Tice | |
| 6,111,511 | A * | 8/2000 | Sivathanu et al. | 340/577 |
| 6,204,493 | B1 * | 3/2001 | Fischl et al. | 250/205 |

(Continued)

FOREIGN PATENT DOCUMENTS

| | | |
|---|---|---|
| GB | 2294794 | 8/2000 |
| GB | 2339946 | 9/2000 |

*Primary Examiner*—Jeffery Hofsass
*Assistant Examiner*—Daniel Previl
(74) *Attorney, Agent, or Firm*—Welsh & Katz, Ltd.

(57) ABSTRACT

A sensor of incident ambient photons is combined, in a detector with one or more sensors responsive to other types of ambient parameters such as gas, humidity, temperature or the like. Outputs from the sensors are processed to establish the existence of one of a hazardous condition, a non-hazardous condition and a false alarm.

20 Claims, 6 Drawing Sheets

U.S. PATENT DOCUMENTS 6,229,439 B1 5/2001 Tice
6,320,501 B1 11/2001 Tice et al.
6,351,212 B1 * 2/2002 Lynch ..... 340/506
6,788,197 B1 * 9/2004 Thuillard et al. ..... 340/522

* cited by examiner

DETECTOR WITH AMBIENT PHOTON SENSOR AND OTHER SENSORS

A computer program listing appendix is submitted herewith on a compact disk. One disk and a second, duplicate identical copy of the disk are being filed herewith. The program on the compact disk is hereby incorporated-by-reference herein. The files present on each disk are:

PTIR PAT. VBP: 1KB
PTIR PAT. FRM: 7KB
PTIR PAT. BAS: 11KB
PTIR PAT. VBW: 1KB

The date of creation of the above-noted files was Aug. 27, 2002.

FIELD OF THE INVENTION

The invention pertains to multi-sensor ambient condition detectors. More particular, the invention pertains to such detectors which incorporate radiant energy, photon, sensors which have an external viewing region relative to the respective detector.

BACKGROUND OF THE INVENTION

Smoke detectors are useful to detect fire conditions within supervised environmental regions. Some examples of these detectors are photo and ionization detectors. Adding gas sensors to smoke detectors can improve the accuracy of discrimination of fire from non-fire conditions. Thermal sensing technologies can also combined with smoke sensors or with gas sensors to form a multi-criteria detector. Thermal sensors are not amenable to inexpensive and convenient self-testing.

The basic problems with combining a gas sensor with another sensor are relatively high costs and reliability issues with the gas sensors. Electrochemical gas sensors have problems with the detection of a sensor failure. Solid state gas sensors have problems with false sensing due to humidity and ambient temperature in addition to high current.

It would be desirable to be able to combine a relatively inexpensive alternate type of sensor with a smoke sensor to be able to enhance fire vs. non-fire discrimination. In addition, it would be desirable if such sensors could be inexpensively and conveniently tested.

DETAILED DESCRIPTION OF THE PREFERRED EMBODIMENTS

Figure 1:
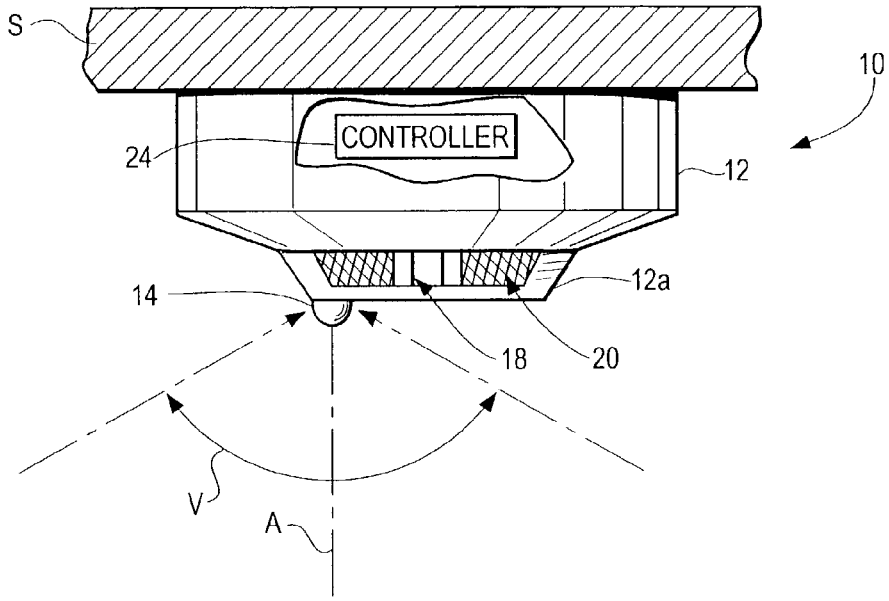
FIG. 1 is a schematic side view illustrating aspects of a detector in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Embodiments of the present invention, discussed subsequently, incorporate multiple different environmental condition sensors in a detector. The sensors provide multiple input signals, responsive to different environmental conditions to a processing unit which in turn can produce a multi-faceted or multi-criteria output indicative of one or more conditions.

It will be understood that the phrase "light sensor" or "photon sensor" as used herein includes transponders or transducers which respond to incident photons to produce electrical signals indicative thereof. Further, the "light sensor(s)" hereof are transponders or transducers which are oriented to receive and respond to incident light, radiant energy, from a region being monitored.

One or more light sensors can be incorporated into a detector to provide a desired field of view in the region being monitored. Except as discussed below, in connection with self-testing, the light sensor(s) of the present detector are not intended to respond to sources of light (for example as present in photo-electric-type smoke sensors, beam-type smoke sensors or the like), generated or present within a detector.

As discussed in detail subsequently, a light sensor is combined with another type of sensor, for example, a smoke sensor that does not respond to photons from an exterior source to form a multiple sensor detector. Outputs from the light sensor(s) and the other sensor(s) may be processed within the same housing. Alternately, a system can combine sensor output signals at a location remote from the detector.

Other types of sensors include but are not limited to gas sensors, thermal sensors, particle counters, smoke sensors, flame sensors, particle counters, smoke sensors, flame sensors, humidity sensors, flow sensors and the like all without limitation. While some of the enumerated sensors include light sources of various types and photon sensing circuits these are intended to be confined in their respective detector, and not emitted into the external region being monitored. They are not intended to respond to photon sources outside of the detector in the region being monitored.

The smoke sensor(s) may be either a photoelectric, an ionization sensor or a beam-type sensor. The photoelectric sensors can use obscuration or scattering sensing principles for the smoke detection.

The light sensor senses incident light from the supervised region. Both amplitude and rate of change characteristics of signals from the light sensor can be analyzed. In one configuration, if the other sensor senses smoke, for example (or heat or gas or flame) and the light sensor senses a change in light, then the detector can make a determination that the potential of a flaming fire condition is high.

Sensing of the light may be simultaneous with sensing of the alternate type of parameter. Alternately, both may be sensed within a predetermined time interval for the processing to determine that they both are representative of the fire condition.

If, for example, the smoke sensor senses smoke and the light sensor does not sensor light, then the detector can make a determination that it is not a flaming fire condition. The condition may be either a smoldering fire or a non-fire.

If, for example, the light sensor senses light and the smoke sensor does not sense any smoke, then the detector can make a determination that it is not a flaming fire condition but more likely a normal ambient light condition. If it is determined that the light sensor is very reliable in discriminating the light as being indicative of a fire or a non-fire condition, then the light sensor's output can be processed to determine if there is a fire condition independent of the output from the smoke sensor.

The light sensor may be responsive to a single-frequency of light. Multiple frequency-type light sensors can further improve the ability of the processing to provide some discrimination as to the type of light source. The sensed frequency or frequencies can be infrared frequencies, visible light frequencies, and ultraviolet frequencies of light.

One inexpensive type of light sensor is a photo diode. Other forms of light sensors can also be used. The advantage of a photo diode as a light sensor is that it is commercially available, very inexpensive, and highly reliable. It can be combined with a circuit to generate a test light or other stimulus of the photo diode to test that it is functional and has not failed.

The preferred embodiment incorporates a single photo diode with a lens formed of a material that is also a light filter to restrict the frequency of light received by the photo diode. Alternately, it is within the scope of the invention not to use a light filter or use a filter within the lens, or a filter external to the lens. Alternately, a photo sensor without a lens could be used.

A controller in the detector or displaced therefrom may include a microprocessor, or circuit logic formed of discrete components. In some combination, the signals from the light sensor and signals from the other sensor can be used by the controller in determining the presence of a fire or non-fire condition.

The controller may analyze the light sensor signals to determine if they in of themselves are representative of a fire or non-fire condition. Different patterns in the light sensor's signals distinguish lamp sources and sun sources from a fire source. These differences can be used in the processing methods to improve the discrimination capability of the controller, whether the controller is within the detector or remote from the detector.

A temperature sensor can also be combined with a light and a fire sensor to form a light/fire/temperature detector. The temperature sensor adds the capability of detecting other changes in the environment that may be associated with a fire condition.

A flaming fire is likely to predominately generate light during the earliest stages. As the fire grows in size, an increasing temperature and rate of change of temperature in the environment will be measurable.

A non-fire condition is likely to not have either a change in the ambient light or an increase in temperature. By combining the sensing of light, the sensing of smoke, for example, and the sensing of temperature, a detector is more likely to be able to discriminate fire from non-fire conditions.

In another embodiment, one or more gas sensors can be used in addition to or as a replacement of any sensor other than the photon sensor. Gas sensors can be responsive to one or more of carbon monoxide, carbon dioxide, hydrocarbons, methane, oxygen, or other gases that either are the byproducts of a fire or are byproducts of non-fires.

If the detected gas is a byproduct of the fire, it may be used in the determination of a fire condition. If the gas is the byproduct of a non-fire, it may be used in the determination of a non-fire or nuisance condition. Both of these can be useful in a detector for discriminating between fires and non-fires.

In another embodiment, a beam type smoke sensor can be located, at least in part, in the detector and used with the photon sensor. The beam smoke sensor will measure the effect of particles in the air resulting from smoke upon the light beam.

As would be known to those of skill in the art, a beam type smoke sensor projects, a beam through a region being monitored. The beam directly impinges on a sensor, or is reflected to a sensor. The beam is in turn disrupted by ambient smoke in the region being monitored.

The beam sensor is differentiated from a photon sensor, even though it projects a light through the monitored region. The beam sensor detects particulate matter in the atmosphere and is not measuring light radiated from a fire source(s). The photon sensor detects the light radiated by the fire source as well as any reflections of that light off of a surface.

A common photon sensor component could be used alone or as part of a beam-type sensor and still remain within the scope of this invention. Likewise, a common photon sensing component could be used in a photo-electric smoke sensor and as a sensor of externally generated photons and be within the scope of this invention. In embodiments of this invention a photon sensor senses the light radiated from the fire sources, and in combination, senses another parameter representative of the environment, such as the obscuration or scattering due to smoke particles of another light source different than the fire source. In this example, a photo diode for example, senses incident external photons and forms part of a photo-type smoke sensor such that there are still two sensing processes. A common component, a photo diode is used in both types of sensors.

The definition of a sensor is not limited to a single component but also includes sensing methods that may share components to reduce costs. For example, a detector contains multiple sensors if that detector contains a light source that emits light that is sensed directly or indirectly by a photo diode to determine a first environmental parameter and that same photo diode senses light emitted by an external fire source to determine a second environmental parameter. This detector actually contains two sensors because the detector has the capability to process the photo diode's output signal to identify two environmental parameters.

As illustrated in FIG. 1, a detector 10 has a housing 12 couplable to a mounting surface S. The housing 10 includes a sensor 14 of light, responsive, for example, to incident light centered at a wavelength of 900 nm.

The sensor 14 can be configured to extend from a surface 12*a*. Alternately, it can be partly or fully within housing 12, without limitation. Lenses are used to implement a wide angle, preferably symmetrical, external field of view.

The light sensor can be coupled to the housing 12 so that it has a wide-angle view V of the region to be monitored. The sensor can be responsive to light from a volume symmetrical about an axis A. It can detect light from sources within the region, outside of the housing 12.

Other mounting positions or methods may be used. More than one light sensor can be used, directed to a field of view outside of the housing 12 to expand the region of detection.

Figure 1A:
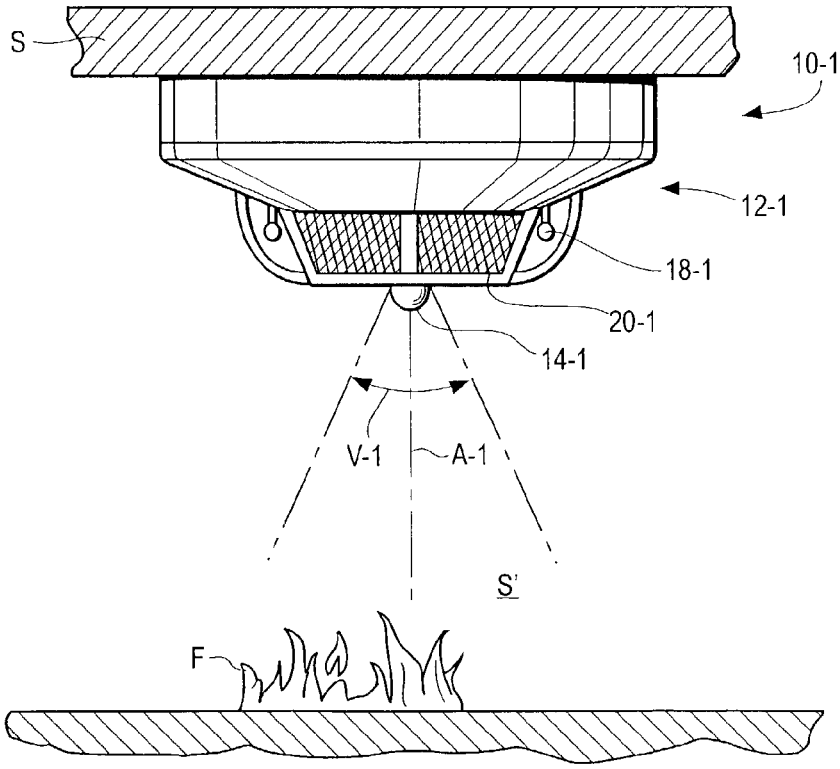
FIG. 1A is a side elevational view of another detector in accordance with the invention.

FIG. 1A illustrates another embodiment, a detector 10-1 which has a housing 12-1. A photon sensor 14-1 is symmetrically mounted on housing 12-1 on an axis A-1. The sensor 14-1 has a viewing angle V-1.

The detector 10-1 incorporates one or more thermisters or temperature sensors 18-1 and a smoke sensor, for example a photo-electric smoke sensor 20-1.

In the detector 10-1, the photon sensor 14-1 has a conically shaped field of view which extends into region S being monitored for potential fire or flames F. Sensor 14-1 is responsive to incident photons from fire F in the region S.

Detector 10 or 10-1 can also include one or more sensors of other parameters 16, thermal sensor 18 and/or smoke sensor 20 for example. Other sensors 16 include gas, humidity condensation, dust or other types of sensors without limitation, can also be used. Such sensors respond to a different ambient parameter than does sensor 14.

A combination of a photon sensor and a temperature sensor represents one embodiment of the invention since the temperature sensor is a non-photon type sensor. More than one externally oriented photon sensor can be implemented in a detector with a sensor of another type of ambient parameter. In other embodiments, different types of light sensors may be implemented in a detector along with one or more sensor(s) of other ambient parameters to provide more reliable monitoring of a selected region.

Figure 2:
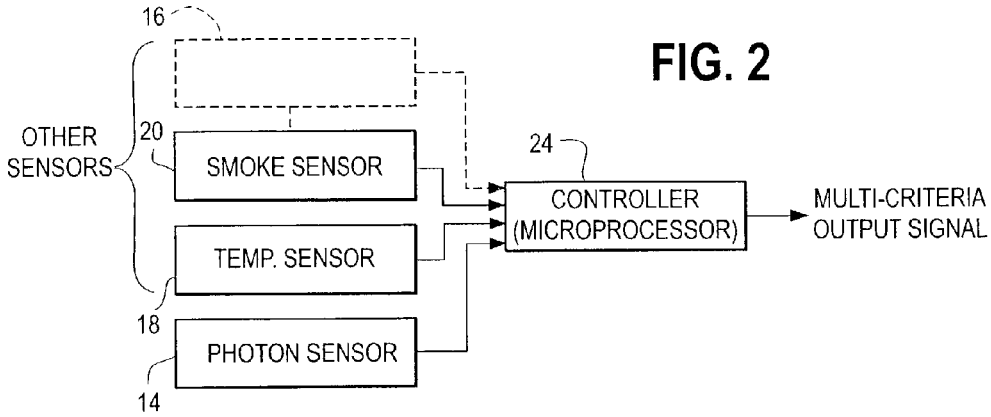
FIG. 2 is a block diagram illustrating aspects of an embodiment of the detector of FIG. 1 or FIG. 1A.
Figure 2A:
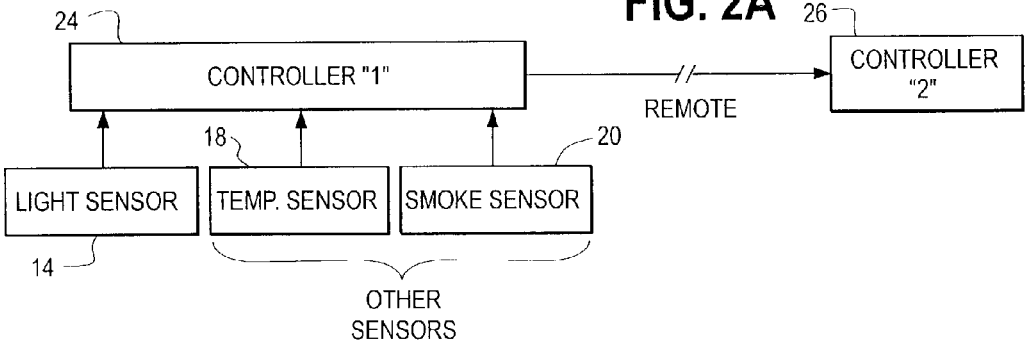
FIG. 2A is a block diagram illustrating aspects of another embodiment of the detector of FIG. 1.

A control circuit, or controller 24 within or displaced from housing 12 combines the signals from the sensors such as light sensor 14, thermal sensor 18, smoke sensor 20, to form a processed output representative of the sensed condition. FIGS. 2 and 2A each illustrate one of many possible configurations of the sensors 14, 16 (illustrated in phantom) 18, 20 and control unit 24 to establish a multi-criteria processed output. It will be understood that other sensors such as gas or humidity could be used instead of or in combination with temperature sensor 18 or smoke sensor 20. The controller in this configuration is implemented, at least in part, as a programmed microprocessor.

In a preferred embodiment, the photon sensor(s) 14, 14-1, whether a single photon responsive element or a composite, multiple photon responsive element, respond to a single wavelength band about a predetermined center frequency. In this configuration, the controller 24 receives signals indicative of externally generated photons incident on the photon sensor, in the predetermined wavelength band, as well as signals indicative of one or more other ambient parameters such as temperature, gases, condensation, smoke or the like.

Figure 2B:
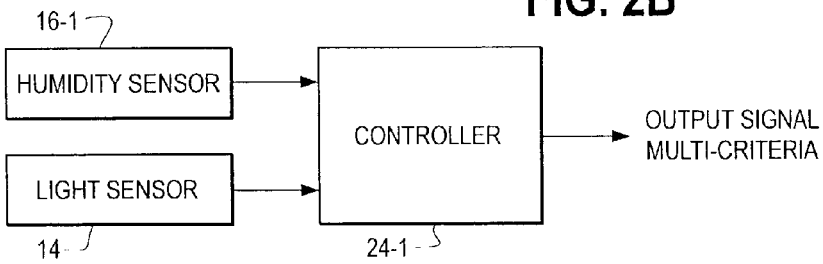
FIG. 2B is a block diagram of a multiple sensor detector in accordance with the invention.
Figure 2C:
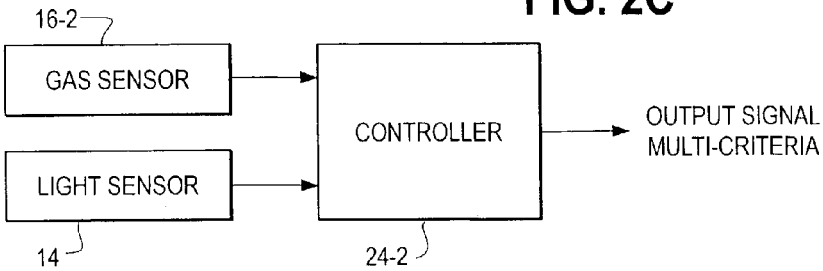
FIG. 2C is a block diagram of another multiple sensor detector in accordance with the invention.

FIGS. 2B, 2C illustrate alternate exemplary configurations of light sensor 14 in combination with a humidity sensor 16-1 (FIG. 2B) and a gas sensor 16-2 (FIG. 2C). Additional, different or the same, types of sensors can be incorporated into the structures of FIGS. 2B, 2C (as illustrated in FIGS. 2, 2A) without departing from the spirit and scope of the invention.

The microprocessor 24 measures each sensor's output value and uses those values as inputs to a series of mathematical calculations to form an output. The logic of this processing may be fixed or dynamic based upon the sensor values.

Active smoothing coefficients or gain adjustments may be determined at least in part by the values from the light sensor 14 and the non-light sensors 18, 20. As the sensor values change, the smoothing changes. As a form of changing the smoothing, multiple mathematical calculations may be running in parallel and the controller 24 can select the output of the appropriate mathematical calculation based upon the sensor values.

Representative forms of processing are disclosed in U.S. Pat. Nos. 5,614,674; 5,659,292; 5,557,262; 5,736,928; 5,831,524; 5,969,604; 6,229,439 and 6,320,501 assigned to the assignee hereof and incorporated by reference herein. Those of skill will recognize that variations in the disclosed forms of processing come within the spirit and scope of the present invention.

Figure 3:
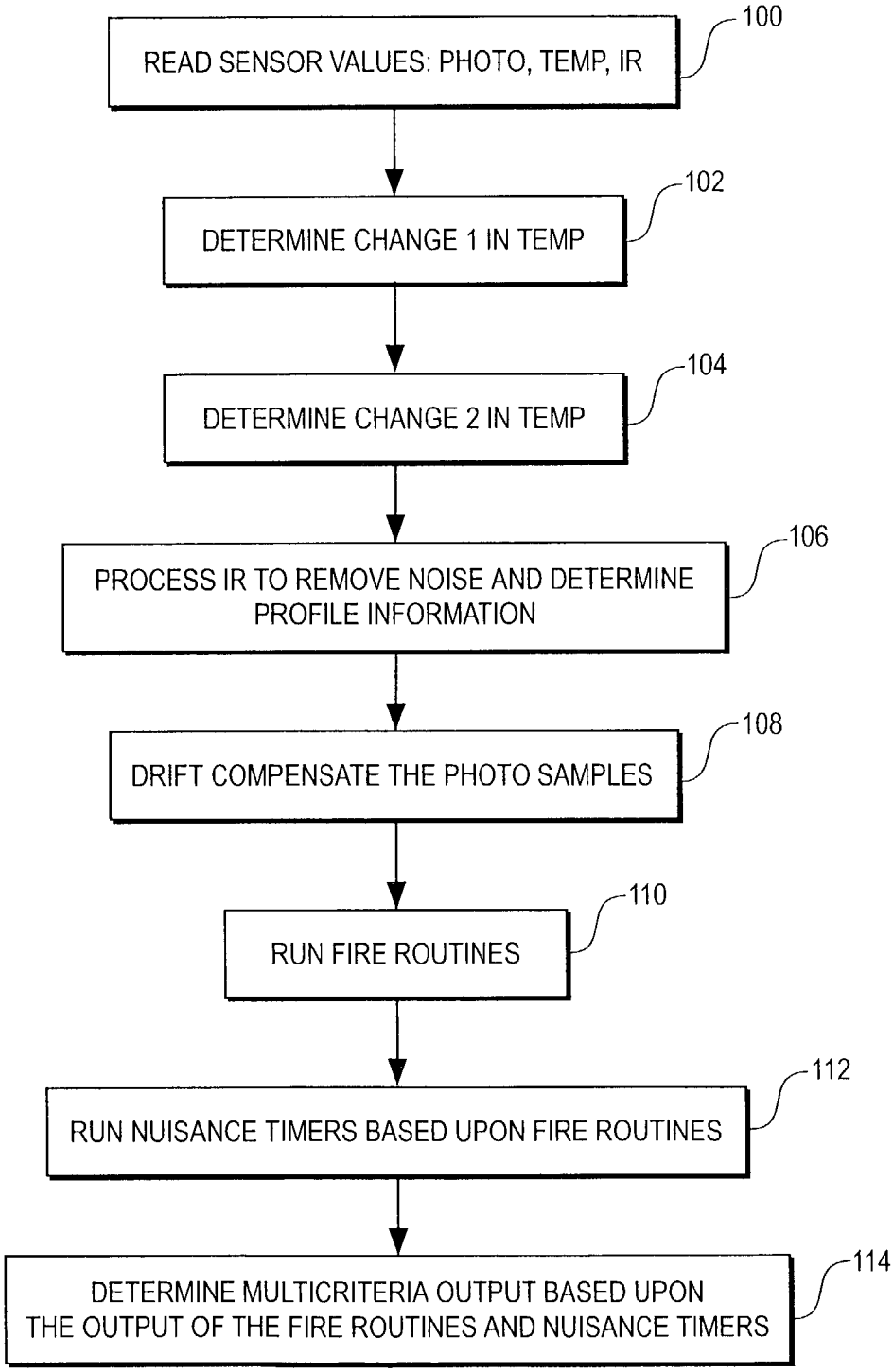
FIG. 3 is a flow diagram illustrating exemplary signal processing for the detector of FIG. 1.

FIG. 3 is a flow diagram illustrating exemplary additional details of processing carried out in processor 24 or 26. In step 100 signal values are acquired from the respective light and non-light sensors. In steps 102, 104 incremental temperature values are determined as functions of temperature and time.

In step 106 signals from the photon sensor are processed to remove noise and to establish a possible fire profile. In step 108 values from one or more of the other sensors such as photo-electric smoke sensors, are compensated, for example for drift and/or noise.

In step 110, software is executed to determine the existence of a potential fire condition. In step 112, nuisance detecting software is executed.

In step 114, a multi criteria output is established. A particular form of output can be provided, in the form of a pulse width. Other output protocols come within the spirit and scope of the invention.

Figure 4:
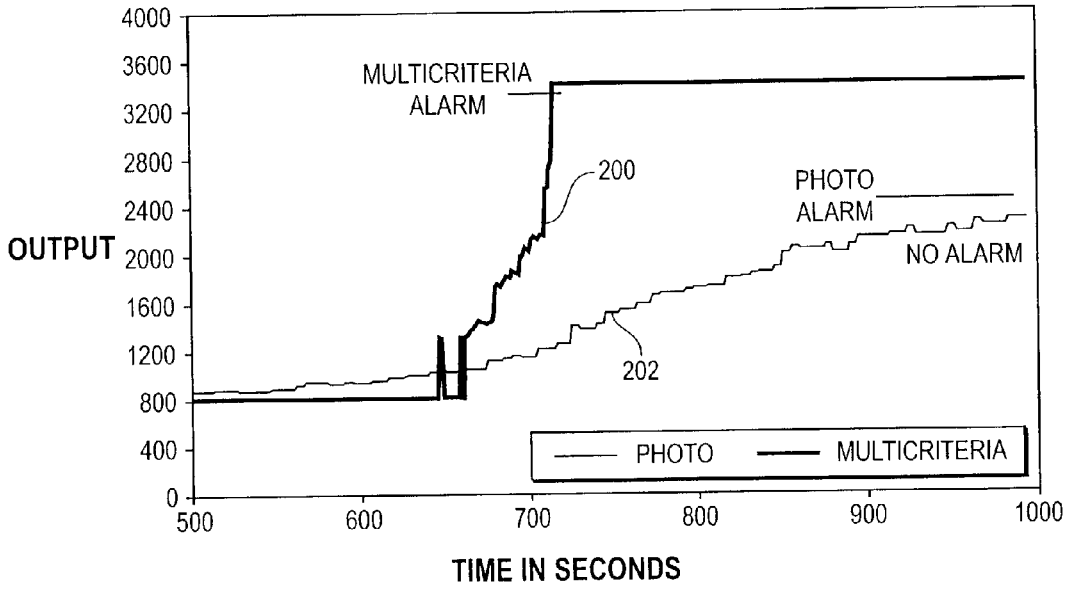
FIG. 4 is a graph illustrating response characteristics for a flaming fire test.

FIG. 4 illustrates exemplary multi-criteria output 200 of the controller 24 in addition to output signals 202 from a photo type smoke sensor alone. The processed output 200 increases faster than the signal 202 from the smoke sensor alone when a flaming fire is present. It is generally lower than the output 202 when a non-flaming fire is present. The processed output 200 represents a combination of the sensor values to determine an output that represents the environmental condition of a fire.

Figure 5:
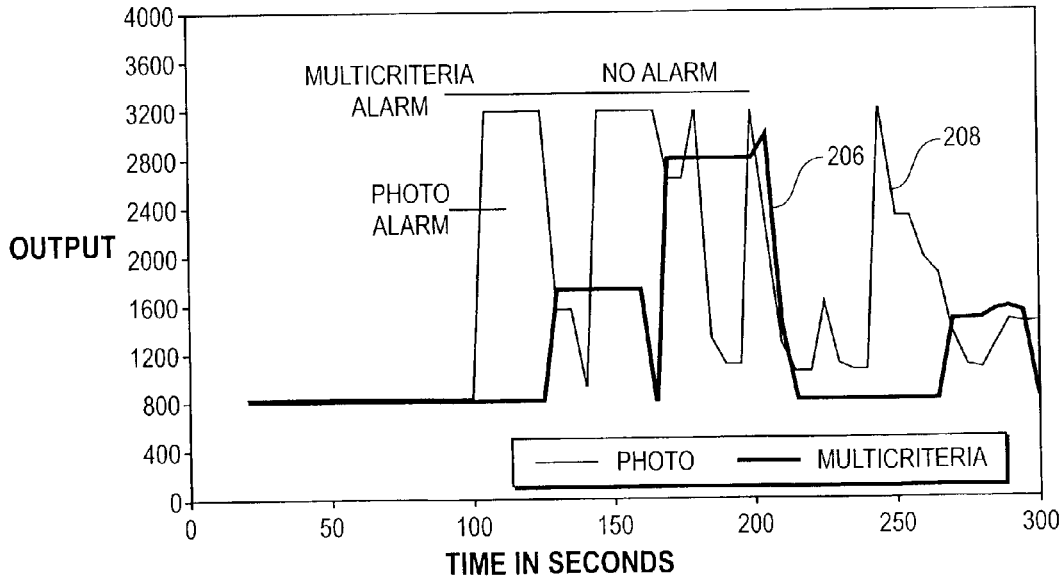
FIG. 5 is a graph illustrating response characteristics for a nuisance test.

FIG. 5 illustrates multi-criteria output 206 from the controller 24 or 26 in addition to the signals 208 from a photo type smoke sensor alone. The processed output 206 has a lesser, non-alarm, magnitude than the output 208 when a non-fire, nuisance, condition is present.

In the method of FIG. 3 which results in the exemplary graphs of FIGS. 4 and 5, the controller is carrying out two forms of mathematical processing simultaneously. One type, step 110, is directed to determining if a fire condition is present. The other, step 112, is directed to determining if a nuisance condition is present. To implement each type of processing pre-stored instructions executed by processor 24 or 26 implement execution of a series of equations. The output of the controller 24 or 26 is thus representative of either a fire or non-fire environmental condition.

Figure 6:
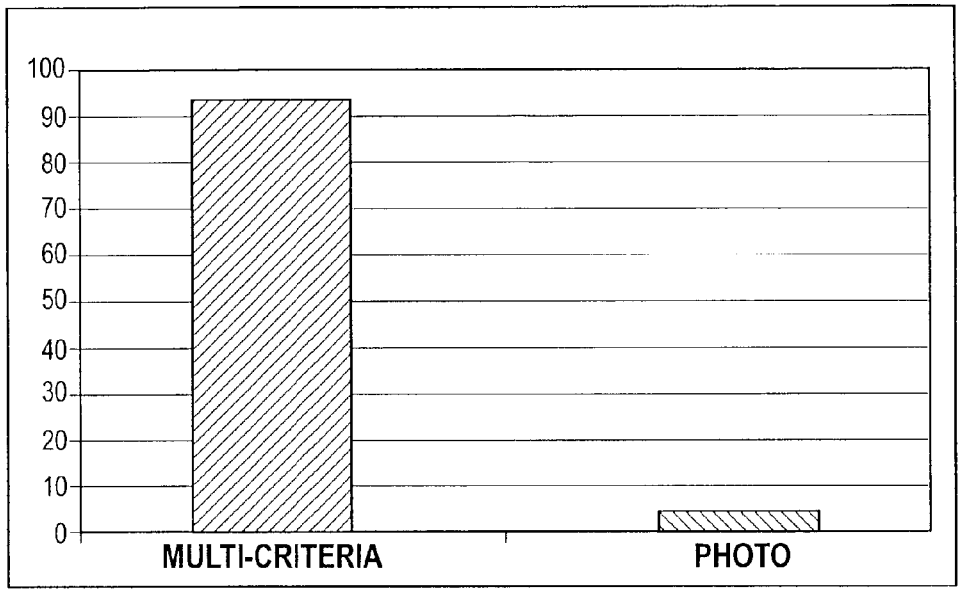
FIG. 6 is a bar chart illustrating nuisance performance characteristics.
Figure 7:
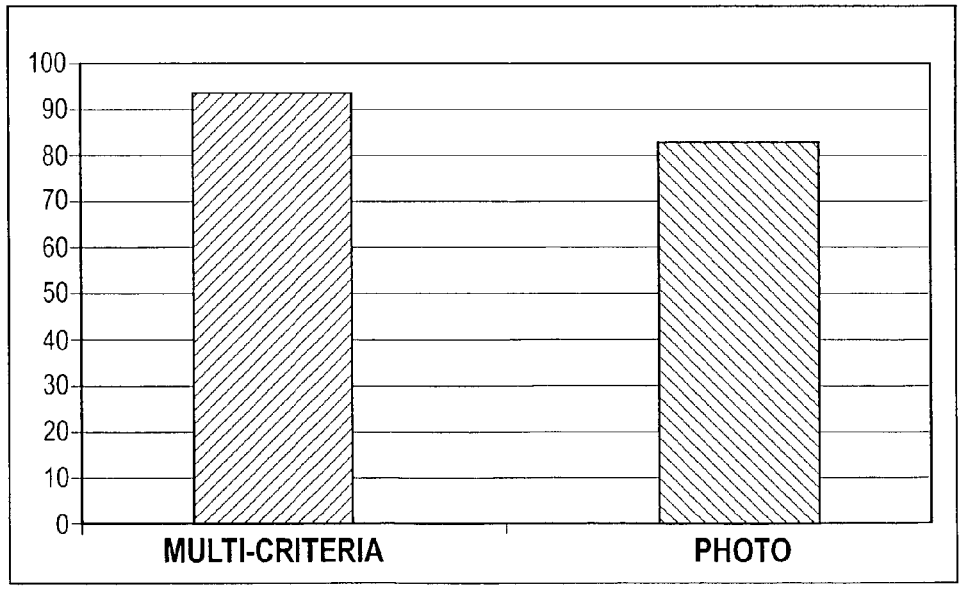
FIG. 7 is another bar chart illustrating performance characteristics of a multi-sensor detector.

FIGS. 6 and 7 illustrate the improved performance of a multi-criteria detector, such as detector 10, relative to a photo detector during a large number of nuisance and early fire conditions. In FIG. 6, the multi-criteria detector was much more accurate than a photo-electric smoke sensor alone in determining a nuisance condition. In FIG. 7, the multi-criteria detector was more accurate than a photo-electric sensor alone in determining a fire condition. The multi-criteria detector of FIGS. 6, 7 incorporated a light sensor, such as sensor 14 and a smoke sensor, such as sensor 20 in combination with a controller 24.

In one mode of processing the light sensor(s) selects the mode of operation of the non-light sensor(s). The mode of operation could include modes ranging from a nuisance mode to a fire mode if fire is the condition to be determined. Other modes of operation or interfaces between the light sensor(s) and non-light sensor(s) are within the scope of this invention.

The light sensor can be tested to determine that it has not failed. This test can be executed by external command, external light stimulus, automatically or periodically during operation.

With an external command, a light source within or on the detector 10 can emit test light detected by the light sensor 14 or 14-1. The response of the light sensor 14 can be monitored to determine that it is operational. The detector 10 or 10-1, may perform the test automatically or periodically. A light source within the detector can be used to test the light sensor 14 and could be controlled in intensity so that the sensitivity of the light sensor can be assessed to determine if it is within predetermined upper and lower limits.

The test light stimulus can include a person using a light source to emit light to be incident on the light sensor. The light sensor can then be monitored to determine that it is operational. The light source may or may not include coded message information. The light source can vary from a device sending a constant light intensity to a remote device that sends varying light intensity signals. This thus includes flashlights and remote controllers as possible light sources for testing the sensor 14, 14-1 to determine that it has not failed.

Figure 8:
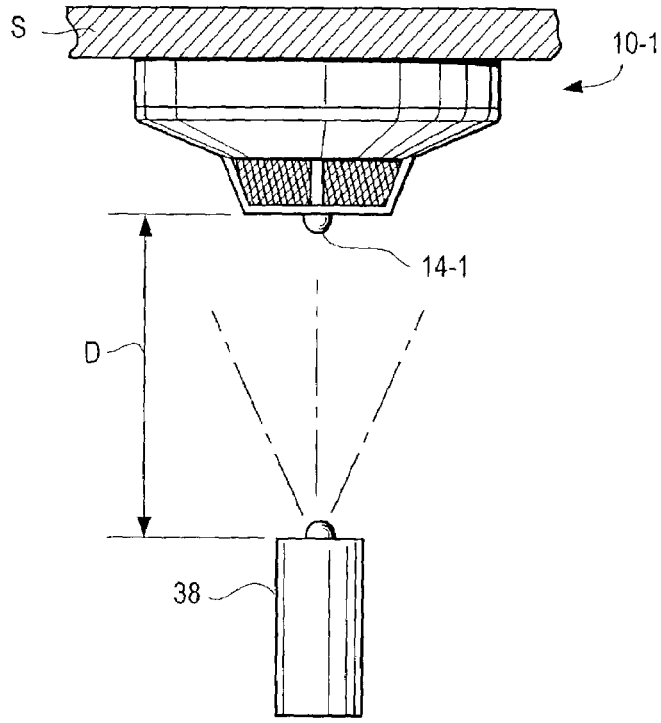
FIG. 8 illustrates one method of testing a detector as in FIGS. 1, 1A.

FIG. 8 illustrates use of a source of light, photons, 38 which can be used to test representative detector 10-1. The source of light 38 can be located a specified distance D from the sensor 14-1 so that the light intensity impinging thereon can be controlled. Detector 10-1 can then respond to this light intensity and form a calibration factor to be used to adjust for changes over time.

As an alternative to using the hand-held source 38, a calibrated light source can be located within the housing 12-1 of detector 10-1. Light emitted from the calibrated light source during a test interval can be detected by the sensor 14-1. The output from the sensor 14-1 can then be used to create a calibration factor to compensate for changes over time.

In one embodiment, the calibrated light source can be located within the housing 12-1 behind the sensor 14-1. In this configuration, enough radiant energy from the calibrated source can be expected to pass through the base of the sensor 14-1 to be detectable.

As another alternate, the detector can monitor the light external to the detector 10, 10-1, during normal operation. Day-time light intensities will usually be greater than evening or night intensities. The monitored light can be used to determine if the light sensor 14, 14-1 is detecting varying light intensities from the environment and thus has not failed. Calibration factors can also be formed.

Representative outputs from the light sensor(s) can be coupled to a controller for the monitoring if the light sensor(s) have failed or are performing within predetermined sensitivity limits. The predetermined sensitivity limits may include at least upper and lower limits.

Figure 9:
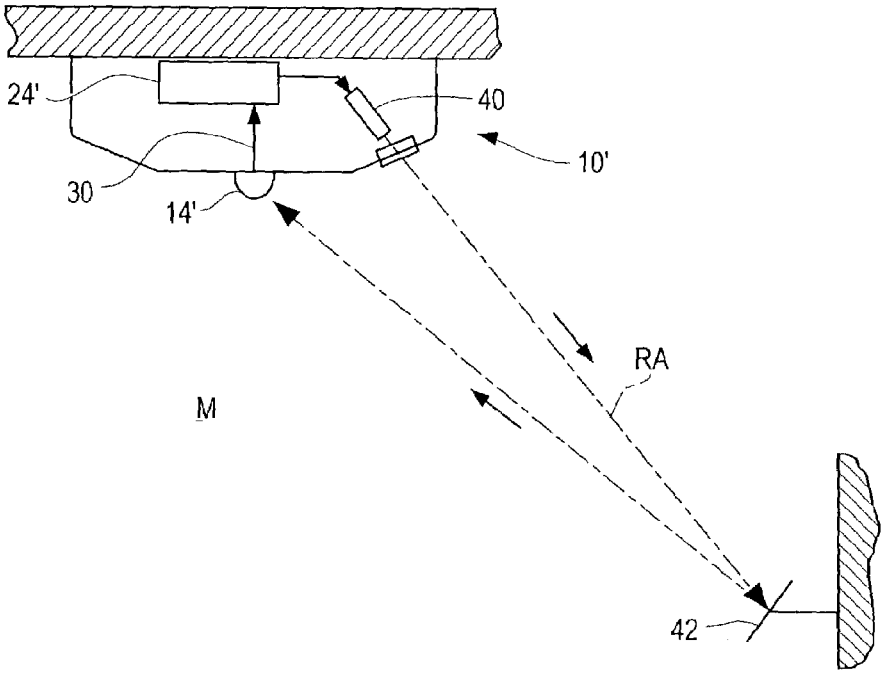
FIG. 9 is a block diagram of another embodiment of the invention.

FIG. 9 illustrates a detector 10' which incorporates a controller or control unit 24' which could be implemented as a programmed processor. Detector 10' incorporates a photon or light sensor 14', comparable to previously discussed light sensor 14, 14-1 which is responsive to incident ambient light received from a region M being monitored. Output signals from sensor 14' can be coupled via conductor 30 to the processor 24'.

Detector 10' also incorporates a source of radiant energy 40 which could be implemented as a laser or a laser diode. The source 40, under control of the unit 24' projects a sensing beam of radiant energy RA across a predetermined portion of the region M being monitored to a reflector 42. The reflector 42 redirects the radiant energy beam RA, back to the light sensor 14'. Smoke in the region M will obscure and/or disperse the beam RA such that when it impinges on the sensor 14', the output therefrom to the unit 24', via line 30, will be indicative of a level of smoke in the region M.

In detector 10', signals from sensor 14' can be time multiplexed with one portion of the output signal on line 30 being the response of the sensor 14' to ambient light originating in the region M, which could be due, for example, to a flaming fire. At another time, the output on the line 30 from sensor 14' can be primarily due to the reflected portion of the beam RA transmitted from the source 40. In this time interval, the sensor 14' is responding to a signal indicative of a level of smoke in the region M, as opposed to a source of radiant energy in the region M.

The time multiplexed signals received from the sensor 14' can be processed at unit 24' to ascertain the presence of a fire or a nuisance condition in accordance with previously discussed processing.

Source 40 could also be used to carry out a test of sensor 14'. Outputs from source 40, reflected to sensor 14' through clear air can provide a calibrated input for test purposes. Alternately, a portion of the output from source 40 could be reflected to sensor 14' at the detector 10'.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A detector for monitoring an environment for a fire comprising:

at least one light sensor that senses light originating from a fire source within the environment and forms at least one output signal indicative thereof;

at least a second sensor that senses a different environmental parameter, selected from a class that includes gas, smoke, temperature, humidity, velocity, and other predetermined environmental parameters, and forms at least a second output signal indicative thereof;

a controller that receives the signals and determines the existence, in response thereto, of a fire and wherein the controller includes circuitry to test the light sensor.

2. A detector as in claim 1 where the controller includes as least one test parameter value usable in evaluating performance of the light sensor.

3. A detector as in claim 2 where the test parameter value comprises at least one of a calibration factor, or an upper or lower limit value.

4. A detector as in claim 1 where the controller, in response to sensor outputs, differentiates between a flaming fire and a smoldering fire.

5. An apparatus for monitoring an environment comprising:

a housing;

at least one sensing element responsive to incident radiant energy indicative of an external environmental condition, the sensing element forming at least one output signal indicative thereof;

where the at least one sensing element is mounted at one of in or on the housing such that radiant energy originating within the environment external to the housing is incident thereon;

at least a second sensor, carried by the housing that senses a different environmental parameter and forms at least a second output signal indicative thereof; and a controller that receives the signals and in response at least to a selected signal from the one sensing element, produced by a calibrated input, the controller evaluates performance of the one sensing element.

6. The apparatus as in claim 5 wherein the output of the controller is coupled to a second, displaced controller.

7. An apparatus as in claim 5 wherein the external photons from within a selected rotational angle around an axis of the housing are incident on the sensing element.

8. An apparatus as in claim 5 wherein the sensing element is responsive to sources of light that include at least one of flames, incandescent lights, florescent lights, daylight, sunlight, and flashlights.

9. An apparatus as in claim 5 which includes an optical filter between the photon sensing element and the incident photons.

10. An apparatus as in claim 5 wherein the second sensor is selected from a class that includes a smoke sensor, a gas sensor, a temperature sensor, a humidity sensor, a dust sensor, and a condensation sensor.

11. An apparatus as in claim 10 wherein the smoke sensor is selected from a class that includes a photo electric-type smoke sensor, an ionization-type smoke sensor, and a beam-type smoke sensor.

12. An apparatus as in claim 5 wherein the second sensor comprises a thermal sensor.

13. An apparatus as in claim 5 wherein the photon sensor includes at least one of a photo diode, a pyro-electric sensor, a thermal-pile sensor, or a passive infrared sensor.

14. An apparatus as in claim 5 wherein the controller monitors the photon sensing element to determine its operational state.

15. An apparatus as in claim 5 wherein the controller monitors the second sensor to determine its operational state.

16. An apparatus as in claims 6 and 7 wherein a trouble signal is generated if a failure of a sensor is detected.

17. An apparatus as in claim 5 where the controller establishes a calibration factor for the one sensing element to compensate for changes over time.

18. An apparatus as in claim 17 where the controller, in response to sensor outputs, differentiates between a flaming fire and a smoldering fire.

19. An apparatus as in claim 5 where the controller compares the selected signal to at least one predetermined performance indicating value.

20. An apparatus as in claim 19 where the controller, in response to sensor outputs, differentiates between a flaming fire and a smoldering fire.

* * * * *